US005239766A

United States Patent [19]

Wang

[11] Patent Number: 5,239,766

[45] Date of Patent: Aug. 31, 1993

[54] RIBBON TOY GUN EQUIPPED WITH CARTRIDGE, LOADING UNIT, AND TRIGGER ASSEMBLY FOR PERCUSSING CARTRIDGES ONE AT A TIME

[76] Inventor: Kun-Meng Wang, No. 2-2, Pei Hsin Road, Pei Hsin Li, Tai Pao City, Chiayi Hsien, Taiwan

[21] Appl. No.: 929,353

[22] Filed: Aug. 14, 1992

[51] Int. Cl.[5] ..... F41C 3/06; F42B 5/03

[52] U.S. Cl. ..... 42/54; 42/38; 446/401; 102/438

[58] Field of Search ..... 42/1.15, 38, 54, 57; 102/438, 458, 505; 446/401

[56] References Cited

U.S. PATENT DOCUMENTS

| | | | |
|---|---|---|---|
| 23,224 | 3/1859 | Barber et al. | 42/38 |
| 1,542,520 | 6/1925 | Reardon | 42/57 |
| 1,831,453 | 11/1931 | Jones | 42/57 |
| 2,897,621 | 8/1959 | Long | 42/54 |
| 3,760,735 | 9/1973 | Schmitt | 102/458 |

FOREIGN PATENT DOCUMENTS

| | | | |
|---|---|---|---|
| 1201196 | 12/1959 | France | 42/1.15 |

*Primary Examiner*—Harold J. Tudor
*Attorney, Agent, or Firm*—Browdy and Neimark

[57] ABSTRACT

The present invention relates to a ribbon toy gun equipped with cartridge, loading unit, and trigger assembly particularly designed to permit the toy gun to shoot the ribbon cartridges one at a time. The ribbon toy gun disclosed mainly consists of a gun shell, a trigger assembly, a generally L-shaped loading unit, and a cartridge filled with colored ribbons. The ribbon toy gun according to the present invention is simple in structure, economical in manufacturing cost, and characterized by larger amount of colored ribbon contained in one single cartridge that gives enhanced visual effect after the cartridge is percussed to explode, and therefore, creates more fun and climaxes the festivity.

1 Claim, 3 Drawing Sheets

RIBBON TOY GUN EQUIPPED WITH CARTRIDGE, LOADING UNIT, AND TRIGGER ASSEMBLY FOR PERCUSSING CARTRIDGES ONE AT A TIME

BACKGROUND OF THE INVENTION

There are many ribbon toy guns commercially available in the market, most of them are featured by the ribbon bullets or cartridges which can be manually or automatically and continuously shot to create joyous air. Since many bullets or cartridges have to be loaded in one ribbon toy gun at the same time, each of the bullets or cartridges may inevitably have only smaller capacity for ribbons. It is therefore tried by the applicant to develop a ribbon toy gun eguipped in such a manner that bullets or cartridges can only be shot one at a time. Such ribbon toy gun has not been previously found in the market and shall provide fun completely different from that of a conventional multi-bullet ribbon toy gun.

SUMMARY OF THE INVENTION

The primary object of the present invention is to provide a ribbon toy gun equipped with cartridge, loading unit, and trigger assembly particularly designed for the toy gun to shoot one single cartridge each time. Such single cartridge permits large quantity of ribbons to be shot and dispersed at one time, climaxing the festivity.

Another object of the present invention is to provide the above ribbon toy gun which is simple in structure and economical in manufacturing cost.

A further object of the present invention is to provide the above ribbon toy gun the trigger assembly of which permits the gun to shot simply by actuating the trigger without the need to firstly or repeatly actuate the percussion head.

BRIEF DESCRIPTION OF THE DRAWINGS

The structure of the present invention and the functions it performs may be best understood through referring to the following detailed description of preferred embodiments and the accompanying drawings wherein.

DETAILED DESCRIPTION OF THE PREFERRED EMBODIMENTS

Figure 1:
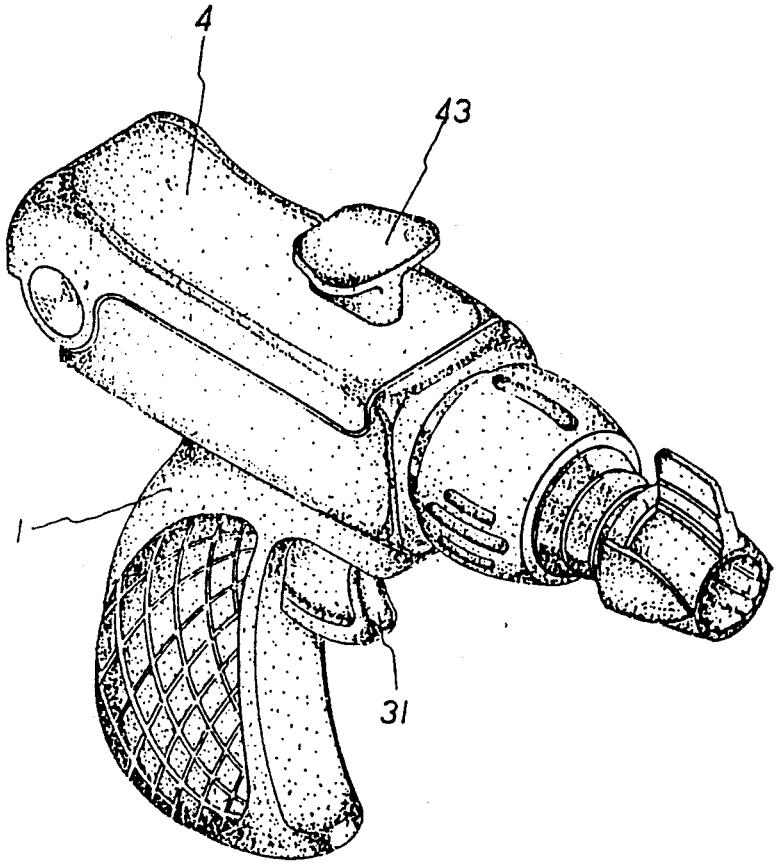
FIG. 1 is a three-dimensional perspective of a ribbon toy gun according to the present invention.
Figure 2:
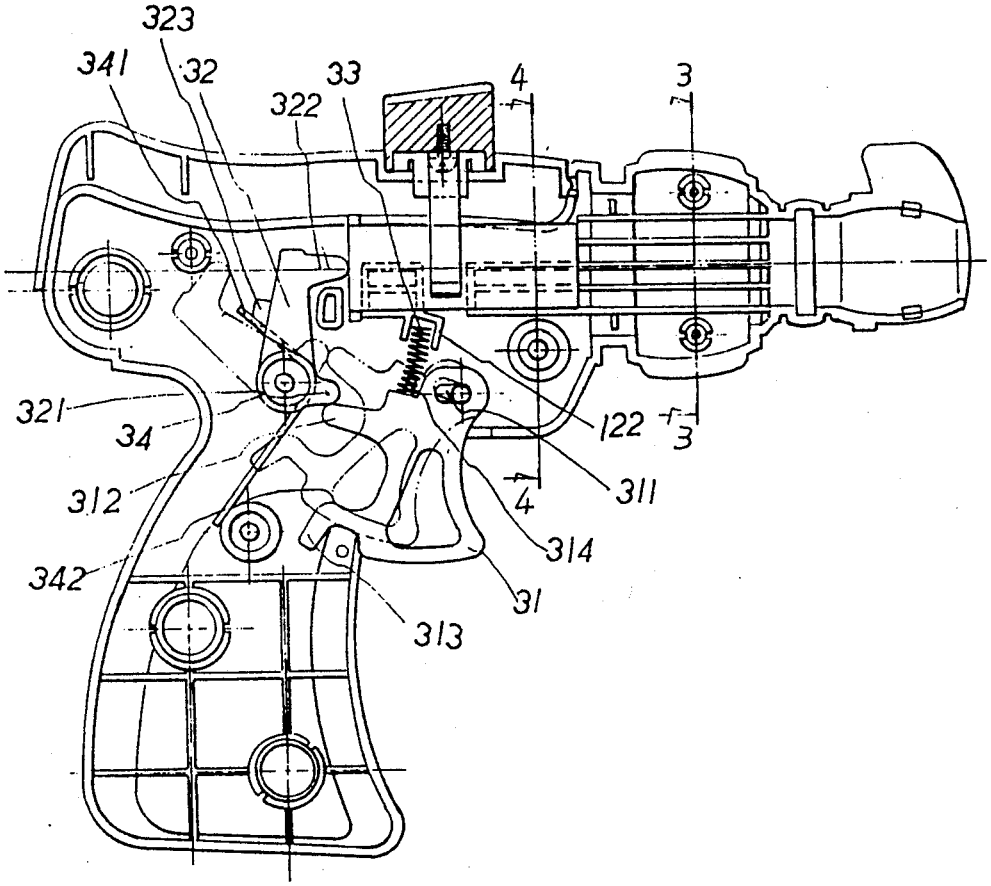
FIG. 2 is a vertical, side, sectional view of the ribbon toy gun of the present invention.
Figure 3:
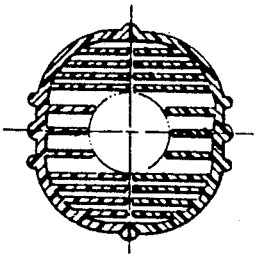
FIG. 3 is a sectional view taken on the line 3—3 of FIG. 2.
Figure 4:
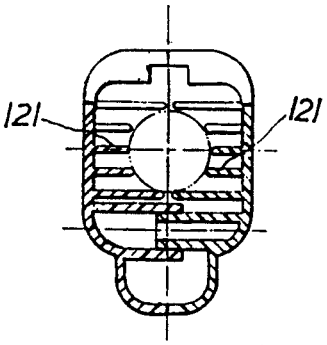
FIG. 4 is a sectional view taken on the line 4—4 of FIG. 2.
Figure 5:
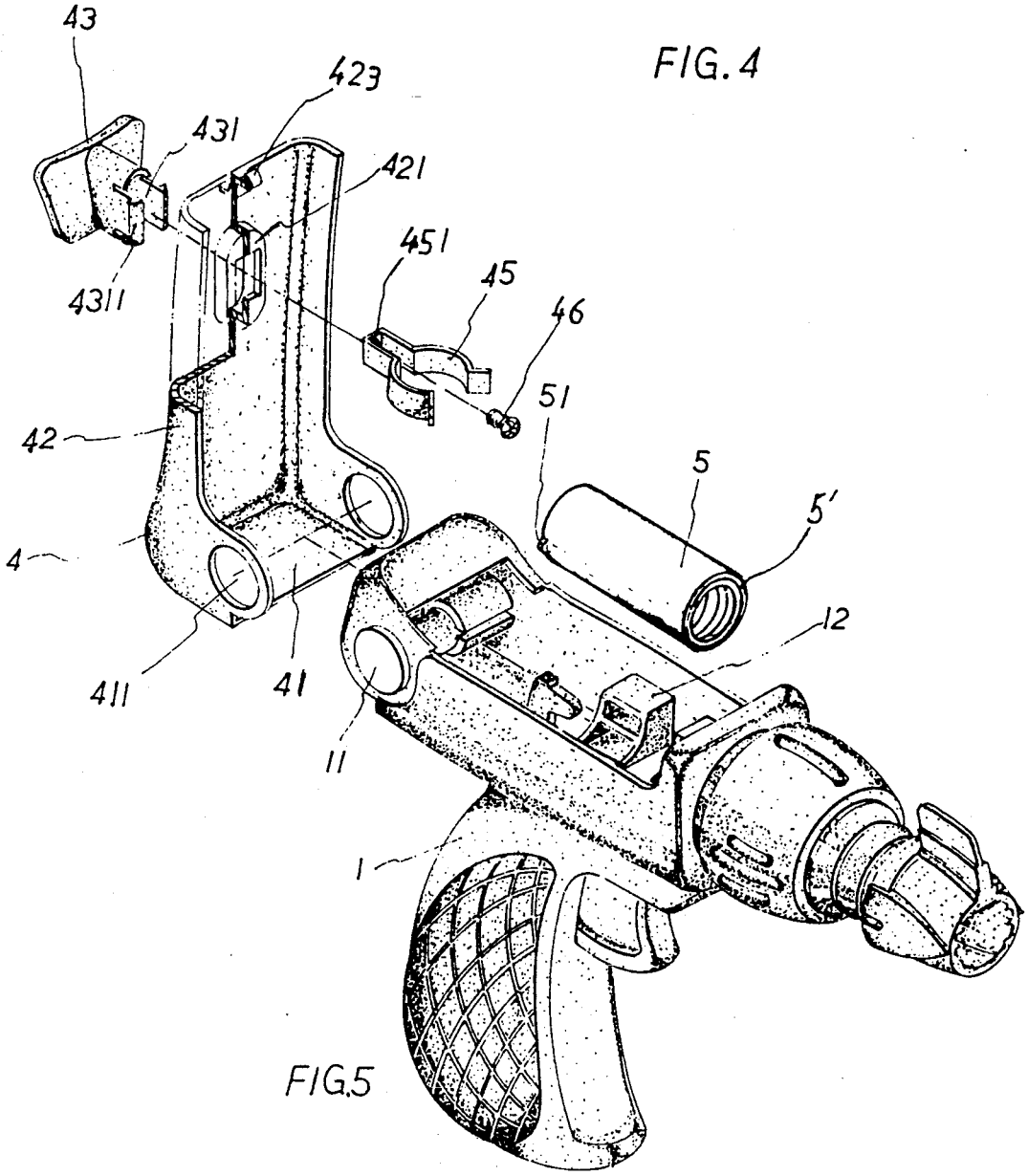
FIG. 5 is a partial, three-dimensional, and analytical perspective showing particularly the loading unit and cartridge of the present invention.

Please refer to FIGS. 1 through 5, the present invention mainly includes a gun shell 1, a loading unit 4, a trigger assembly, and ribbon cartridges 5, which are particularly designed to shoot ribbon cartridges 5 one at a time.

The gun shell 1 according to the present invention is formed by combining two laterally symmetrical parts by engaging pins provided at adequate positions along periphery of the shell and consists of a grip handle, a barrel, and a cartridge chamber between the grip handle and the barrel. The cartridge chamber has a semicircular cartridge seat 12 with its opening facing upward and being divided into a front and a rear portion, a plurality of laterally and inwardly extended retaining members 121 being provided on inner wall of the semicircular cartridge seat 12 for firmly holding a cartridge (a ribbon bullet) 5 therebetween, and a downwardly open barrel-like means 122 being further provided below bottom rear portion of the cartridge seat 12 for receiving one end of a thrust spring 33 therein.

The trigger assembly mainly consists of a trigger member 31, a percussion member 32, a thrust spring 33, and a percussion spring 34. The trigger member 31 is a generally triangular frame and has an ellipsoidal hole 311 for a gun shell pin to pass through and thereby slidably holds the trigger member 31 thereto, a projected arm 312 provided at rear side thereof, a check hook 313 provided at lower rear corner thereof for hooking and thereby being stuck by the upper front inner edge of the grip handle, a stop block 314 formed at upper rear corner thereof to receive and hold another end of the thrust spring 33.

The percussion member 32 is generally ⌐-shaped in configuration and is pivotly fixed to a fixing pin connected with the gun shell 1. The upper laterally extended part of the percussion member 32 is a percussion head 322 and the lower shank part thereof has a stop block 323 projected backward from its rear back and a lower front projection 321 which is normally stopped by the projected arm 312 of the trigger member 31 from moving downward.

The percussion spring 34 fixedly connects to the percussion member 32 in such a manner that its two extended ends 341, 342 push against the stop block 323 of the percussion member 32 and a grip handle pin formed inside the grip handle, respectively.

The loading unit 4 is generally L-shaped in configuration and has a ⊓-shaped cross section. The shorter part 41 of the loading unit 4 is formed of two corresponding round through holes 411 which each pivotly engages with one projected end of a joining pin 11 provided at rear end of the gun shell 1 so that the entire loading unit 4 is allowed to be pivotly lifted upward about the joining pin 11. The longer part 42 of the loading unit 4 is formed of a projected means 423 below its front edge for detachably fastening the loading unit 4 to the shell of the ribbon toy gun 1. An ellipsoidal hole 421 is formed on top surface of the longer part 42 of the loading unit 4 for a generally T-shaped clamping means 43 to pass therethrough. Two legs 431 in adequate length extend downward from bottom surface of the T-shaped clamping means 43 and each has a rounded and outward and laterally projected bottom edge 4311 which permit the T-shaped clamping means 43 to be firmly held to the ellipsoidal hole 421 after it passes through there. When the T-shaped clamping means 43 is inserted into the ellipsoidal hole 421, the two legs 431 thereof would fitly clamp a cartridge holder 45. The cartridge holder 45 has a ⊓-shaped top portion and two convex binding members extended from two lower edges of the ⊓-shaped top portion with a downward opening and two outward extended guiding plates at two sides of the opening. A self-tapping screw 46 is used to firmly fasten the cartridge holder 45 to the T-shaped clamping means 42 via a through hole 451 formed at center of the ⊓-shaped top portion of the cartridge holder 45. The cartridge 5 is generally cylindrical in configuration.

protuberances 51 are provided at opposite positions on the outer edge of the bottom percussion surface of the cartridge 5. Large amount of colored ribbons 51 may be contained in the cylindrical cartridge 5.

In operation, first lift up the L-shaped loading unit 4, put and push a piece of color-ribbon-filled cartridge 5 against the cartridge holder 45 so that the cartridge 5 is firmly clamped by the holder 45 in place. Press down the loading unit 4, allowing its front projected means 423 to engage with the gun shell 1. At this point, the cartridge 5 shall be located in the cartridge chamber on the semicircular cartridge seat 12 and is retained by the retaining members 121. When the trigger member 31 is pulled backward, the projected arm 312 thereof is shifted to push the lower front projection 321 of the percussion member 32 to move upward and backward, and the stop block 314 thereof simultaneously upward compresses the thrust spring 33. The percussion member 32 is forced to move backward by the pulled trigger member 31 and tenses the percussion spring 34. When the lower front projection 321 of the percussion member 32 is moved to a certain position which causes it to disengage from the projected arm 312 of the trigger member 31, the projected arm 312 instantaneously loses resistance from the projection 321 and is sprung back to its original position by the energy stored in the compression spring 33. At the same time, the stored recovery force in the tensed percussion spring 34 shall cause the percussion head 322 of the percussion member 32 to dash toward and powerfully impact on the bottom percussion surface of the cartridge 5, shooting out and exploding the colored ribbons in the cartridge 5. Then, lift up the loading unit 4 again, remove the empty cartridge 5.

The features of the present invention include:

1. The structure of the ribbon toy gun of the present invention is simple and therefore reduces the manufacturing cost thereof.

2. The ribbon toy gun is designed to shoot cartridges one at a time, therefore, the cartridge, when comparing with other toy guns in similar size, shall have rather bigger capacity which shall have much powerful explosive force when the cartridge is percussed, causing large amount of colored ribbons to be dispersed and forming enhanced interesting and festival air.

3. The trigger member is always in a state ready for percussion without the need to shift the percussion head each time.

What is claimed is:

1. A ribbon toy gun equipped with ribbon cartridge, loading unit, and trigger assembly particularly designed for percussing ribbing cartridges one at a time, comprising:

a gun shell which is formed by combining two laterally symmetrical parts by engaging joining pins provided at adequate positions on said gun shell, consisting of a grip handle, a barrel constituting front portion of said gun shell, and a cartridge chamber between said grip handle and said barrel; said cartridge chamber having a semicircular cartridge seat with its opening facing upward and being divided into a front portion and a rear portion; a plurality of laterally and inwardly extended retaining members being provided on inner wall of said semicircular cartridge seat for firmly holding a cartridge therebetween; and a downwardly open barrel-like means being further provided below bottom rear portion of said cartridge seat for receiving one end of a thrust spring therein;

a trigger assembly mainly consisting of a trigger member, a percussion member, a thrust spring, and a percussion spring;

said trigger member being a generally triangular frame and having an ellipsoidal hole for a gun shell pin to pass through and thereby slidably holds said trigger member thereto, a projected arm provided at rear side of said trigger member, a check hook provided at lower rear corner thereof for hooking and thereby being stuck by upper front inner edge of said grip handle, a stop block formed at upper rear corner thereof to receive and hold another end of said thrust spring;

said percussion member being generally Γ-shaped in configuration and being pivotally fixed to a fixing pin connected with said gun shell, upper laterally extended part of said percussion member being a percussion head and lower shank part of said percussion member having a stop block projected backward from its rear back and a lower front projection which is normally stopped by said projected arm of said trigger member from moving downward; and said percussion spring fixedly connecting to said percussion member in such a manner that its two extended ends push against said stop block of said percussion member and a grip handle pin formed inside said grip handle, respectively;

a loading unit being generally L-shaped in configuration and having a ⊓-shaped cross section; a shorter part of said loading unit having been formed of two corresponding round through holes which each pivotally engages with one projected end of a joining pin provided at rear end of said gun shell so that said entire loading unit is allowed to be pivotally lifted upward about said joining pin; and a longer part of said loading unit having a projected means below its front edge for detachably fastening said loading unit to said gun shell; and ellipsoidal hole being formed on top surface of said longer part of said loading unit for a generally T-shaped clamping means to pass therethrough; two legs in adequate length extend downward from a bottom surface of said T-shaped clamping means and each having a rounded and outward and laterally projected bottom edge which permits said T-shaped clamping means to be firmly held to the ellipsoidal hole after it passes through there; said two legs of said T-shaped clamping means clamping a cartridge holder when said T-shaped clamping means is inserted into said ellipsoidal hole; said cartridge holder having a ⊓-shaped top portion and two convex binding members extended from two lower edges of said ⊓-shaped top portion with a downward opening and two outward extended guiding plates at two sides of said opening; and a self-tapping screw firmly fastening said cartridge holder to said T-shaped clamping means via a through hole formed at center of said ⊓-shaped top portion of said cartridge holder; and a cartridge being generally cylindrical in configuration, having protuberances provided at opposite positions on outer edge of bottom percussion surface of said cartridge, and large amount of colored ribbons contained therein; and said L-shaped loading unit being able to be lifted up, allowing a piece of color-ribbon-filled cartridge to be put in and pushed against said cartridge holder so that said cartridge is firmly clamped by said holder in place and then, being pressed down for said front projected means to engage with said gun shell and said cartridge to locate in said cartridge chamber on said semicircular cartridge seat and to be retained by said retaining members;

said trigger member being able to be pulled backward so that said projected arm thereof is shifted to push said lower front projection of said percussion member to move upward and backward, and said stop block thereof to simultaneously upward compress said thrust spring;

said pulled trigger member being able to force said percussion member to move backward which tenses the percussion spring until said lower front projection of said percussion member is moved to a certain position which causes it to disengage from said projected arm of said trigger member, causing said projected arm instantaneously to lose resistance from said projection and is sprung back to its original position by energy stored in said compression spring; and said tensed percussion spring being able to cause said percussion head of said percussion member to dash toward and powerfully impact on bottom percussion surface of said cartridge when said trigger member is sprung back to its original position by said compression spring, and thereby, to shoot out and explode colored ribbons in said cartridge.

* * * * *